US006647558B2

(12) United States Patent
Falchieri

(10) Patent No.: US 6,647,558 B2
(45) Date of Patent: Nov. 18, 2003

(54) DISPENSER FOR SANITIZING/DEODORANT SURFACTANT LIQUIDS, PARTICULARLY FOR TOILET BOWLS

(75) Inventor: Roberto Falchieri, Bologna (IT)

(73) Assignee: Falp S.r.l., Passo Segni di Baricella (IT)

( * ) Notice: Subject to any disclaimer, the term of this patent is extended or adjusted under 35 U.S.C. 154(b) by 4 days.

(21) Appl. No.: 10/323,634

(22) Filed: Dec. 20, 2002

(65) Prior Publication Data

US 2003/0088908 A1 May 15, 2003

Related U.S. Application Data

(62) Division of application No. 09/734,843, filed on Dec. 13, 2000, now Pat. No. 6,519,783.

(30) Foreign Application Priority Data

Dec. 14, 1999 (IT) ..... BO99A0677

(51) Int. Cl.[7] ..... E03D 9/03
(52) U.S. Cl. ..... 4/227.7; 4/223; 4/231
(58) Field of Search ..... 4/222–224, 227.4–227.7, 4/229–231, 309; 422/292, 300; 222/457; D6/542

(56) References Cited

U.S. PATENT DOCUMENTS

| | | | | |
|---|---|---|---|---|
| 1,091,265 | A | 3/1914 | Wohlander | |
| 1,925,959 | A | 9/1933 | Gregor | |
| 3,946,448 | A | 3/1976 | Sioufy | |
| 4,168,551 | A | 9/1979 | Hautmann et al. | |
| 5,074,328 | A | 12/1991 | Reinders | |
| D419,347 | S | 1/2000 | Leonard | |
| 6,178,564 | B1 | 1/2001 | Leonard et al. | |
| 6,526,599 | B2 * | 3/2003 | Benayahoo | 4/227.7 |

FOREIGN PATENT DOCUMENTS

| | | |
|---|---|---|
| DE | 299 12 647 | 9/1999 |
| EP | 0 538 957 | 4/1993 |
| EP | 0 773 300 | 5/1997 |
| EP | 0 878 586 | 11/1998 |
| EP | 1 046 756 | 10/2000 |
| EP | 1 130 178 | 9/2001 |
| WO | A-99 66140 | 12/1999 |

* cited by examiner

*Primary Examiner*—Tuan N. Nguyen
(74) *Attorney, Agent, or Firm*—Guido Modiano; Albert Josif; Daniel O'Byrne

(57) ABSTRACT

A dispenser for sanitizing/deodorant surfactant liquids, particularly for toilet bowls, including a container, which is provided at an end thereof with a tray element having at least one cavity in continuous communication with the container; the cavity is provided with at least one outlet for the controlled dispensing of a surfactant liquid.

18 Claims, 5 Drawing Sheets

DISPENSER FOR SANITIZING/DEODORANT SURFACTANT LIQUIDS, PARTICULARLY FOR TOILET BOWLS

RELATED APPLICATION

This application is a divisional of Ser. No. 09/734,843 filed Dec. 13, 2000, which is now U.S. Pat. No. 6,519,783.

BACKGROUND OF THE INVENTION

The present invention relates to dispensers for sanitizing/deodorant surfactant liquids, particularly for toilet bowls.

As it is known, several types of dispensers for sanitizing/deodorant liquids are currently commercially available, in which the fluid is dispensed according to the most disparate criteria.

In particular, it was observed that the systems currently used for dispensing the sanitizing/deodorant liquid are extremely complicated and difficult to assemble.

They consist in fact of a number of components which have to be assembled properly. Moreover they suffer problems both regarding delivery of the liquid to be dispensed and positioning of the dispenser in the toilet bowl.

SUMMARY OF THE INVENTION

The aim of the present invention is therefore to eliminate the above mentioned drawbacks encountered in the prior art dispensers and to provide a dispenser which is easy to assemble.

Within this aim, an object of the invention is to provide a dispenser which has a simple structure, is relatively easy to manufacture, safe in use and effective in operation, and has a relatively low cost.

This aim and this and other objects which will become better apparent from the following description, are achieved by the present dispenser for sanitizing/deodorant surfactant liquids, particularly for toilet bowls, characterized in that it comprises a container having at an end thereof a tray element provided internally with at least one cavity, in continuous communication with said container, said cavity being provided with at least one outlet for the controlled dispensing of said surfactant liquid.

BRIEF DESCRIPTION OF THE DRAWINGS

Further characteristics and advantages of the invention will be better understood from the following detailed description of a preferred but not exclusive embodiment of a dispenser for sanitizing/deodorant surfactant liquids according to the invention, illustrated only by way of an illustrative but not limitative example in the accompanying drawings, wherein.

DESCRIPTION OF THE PREFERRED EMBODIMENTS

Figure 1:
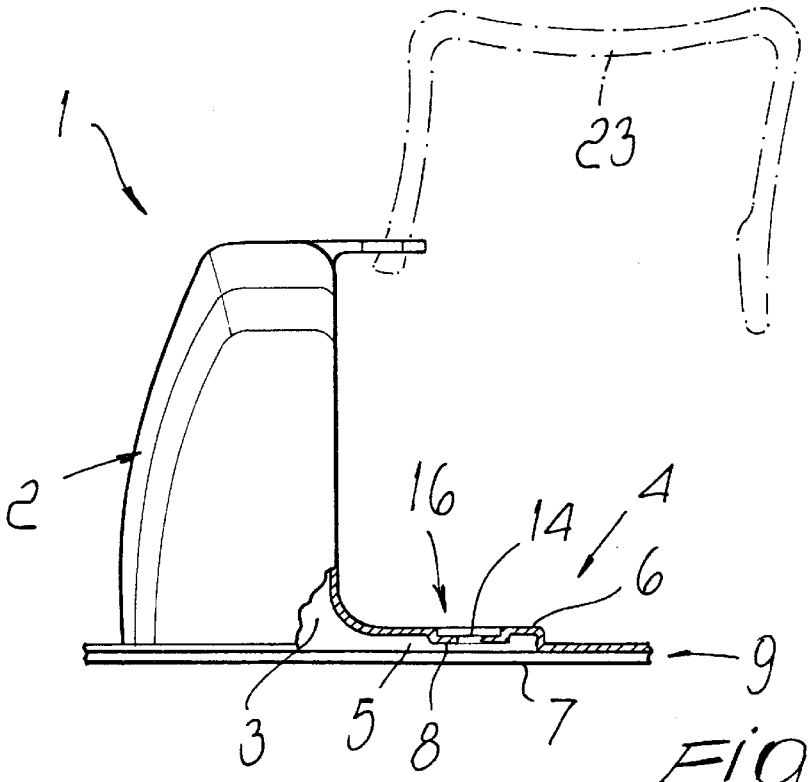
FIG. 1 is a side elevation partially cut away view of a first embodiment of the dispenser according to the invention.

With reference to the above mentioned drawings 1–6, reference numeral 1 generally indicates a dispenser according to the invention.

The dispenser 1 comprises a container 2 for liquids produced by thermoformation. The container 2 is provided at a lower end 3 thereof with a tray element 4 having internally a cavity 5 in continuous communication with the inside of the liquid container 2. Said cavity 5 is defined by a first wall 6 and a second wall 7 facing each other and gradually tapering to a neck 8. Tray element 4 has also an outer lip 9 in which weakening lines 10 define one or more tearing strips 12. By removing one or more of the tearing strips 12, with the dispenser 1 placed in the toilet bowl, it is possible to adjust the distance of the tray 4 to the walls of the toilet bowl itself.

Downwardly from the neck 8, the tray 4 has an outlet 14 closed by an adhesive type cap, not shown in the drawings, to be removed before use. The outlet 14 allows the liquid to flow outwards from the inside of the container 2 and is designed, as specified hereinafter, so as to be located substantially below the rim of the toilet bowl and thus be impinged upon by the flushing water of the toilet bowl.

The first wall 6 is made monolithic with the container 2 and peripherally defines an edge 15 to which the second wall 7, made of a film of plastic material is thermosealed. Thermosealing of the second wall 7 to the edge 15 allows to close the container 2 after filling it with liquid, so as to obtain a monolithic dispenser 1.

With reference to FIGS. 1 to 4, in a first embodiment, the outlet 14 is placed at an indentation or recess 16 which is formed on the first wall 6.

Figure 2:
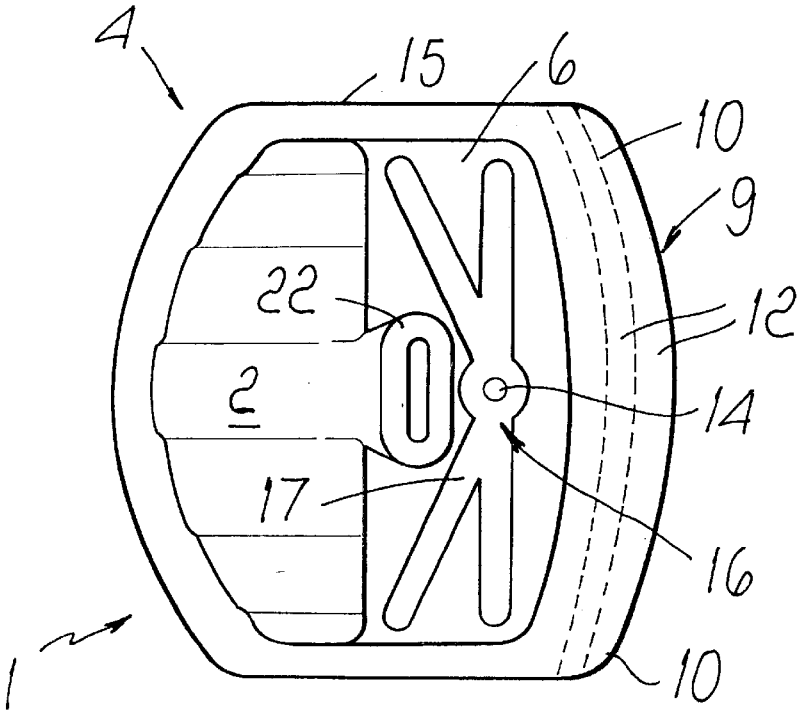
FIG. 2 is a top view thereof.
Figure 3:
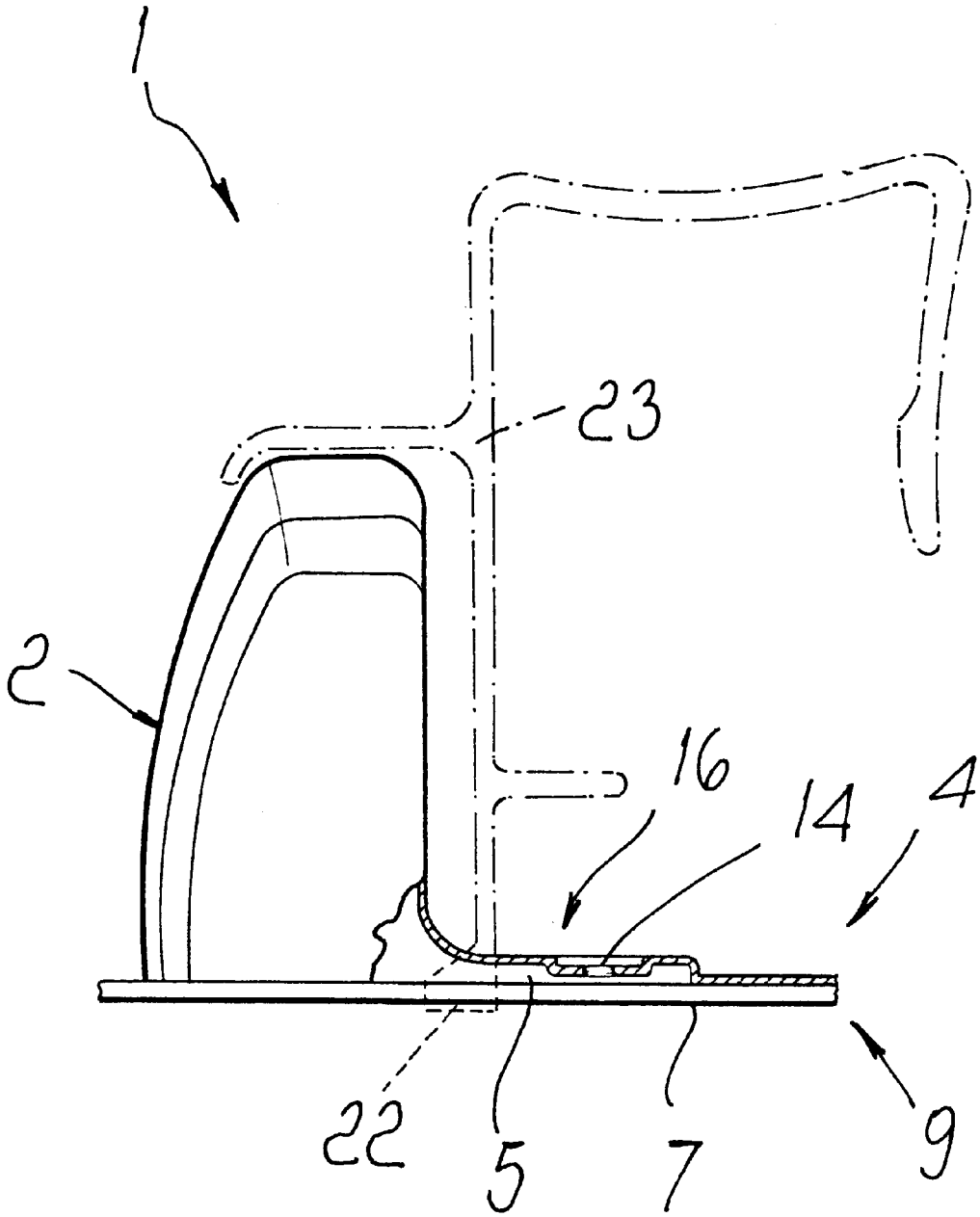
FIG. 3 is a side elevation cross-sectional view of a different embodiment of the coupling means for coupling the dispenser on the rim of a toilet bowl.

As shown in FIG. 2, the indentation 16 forms diffusion grooves or races 17, preferably facing upwards, which extend in a radial pattern or web from the central area of the first wall 6. In this embodiment, the outlet 14 is at the center of the web in order to allow a uniform diffusion of the fluid coming from inside the container.

Figure 4:
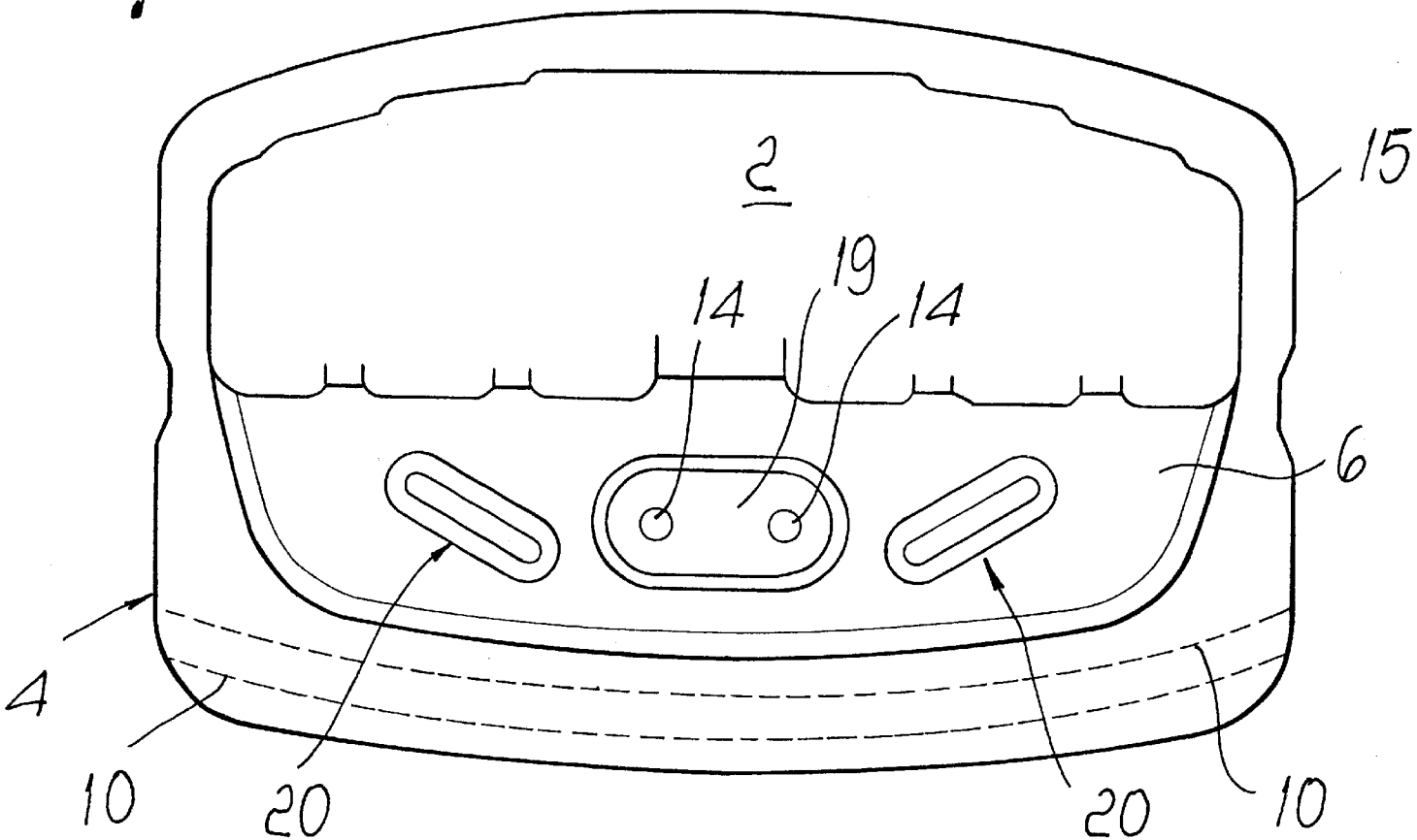
FIG. 4 is a top view of an embodiment of the outlet which is different from that of FIG. 1.

In another embodiment, as shown in FIG. 4, the indentation 16 forms a cup 19 for collecting the liquid coming from the inside. The cup 19 preferably faces upwards and has, at the center thereof, at least one outlet 14 and, adjacent thereto, spacers 20 which are provided during the thermoformation. Said spacers have the function of keeping constant the section of the cavity 5, during operation.

The dispenser 1 is provided with a hanger 22 associated with the container 2 for allowing the vertical positioning of said container in the toilet bowl, so that the cup 19 or the diffusion grooves face upwards. A hook 23 is connected to the hanger 22, which interlockingly engages the rim of the toilet bowl. Finally, the positioning of the dispenser 1 inside the toilet bowl is facilitated by the tearing strips 12 which, by being properly removed, allow to adjust the distance between the tray 4 and the wall of the toilet bowl.

In operation, upon removing the adhesive cap and upon placing the dispenser 1 in the toilet bowl, the liquid inside it flows outwards filling the grooves 17 or cup 19, due to the potential energy or static head of the liquid column in the container with respect to the liquid column inside the cup 19. In fact, after a generic mechanic transient state in which the cup or grooves are filled up, the potential energy transforms into kinetic energy, thus imparting to the liquid flow a velocity for moving from inside the container 2 to the cup 19. Said liquid flow transfer velocity depends on the resistance opposed to the fluid flow by the cavity section and by the neck. In fact, by changing said resistance, the flow transfer velocity and consequently the time required for filling the cup 19 and the grooves 17 is changed accordingly. The liquid flow stops when the surface tension in the cup or the grooves balances the liquid pressure inside the container. From the above, it can be inferred that by changing the section of the cavity and of the outlet it is possible to adjust the dispensing capacity of the dispenser. Once the liquid is deposited in the cup or the grooves, it will be washed away by part of the water flow for flushing the toilet bowl.

Figure 5:
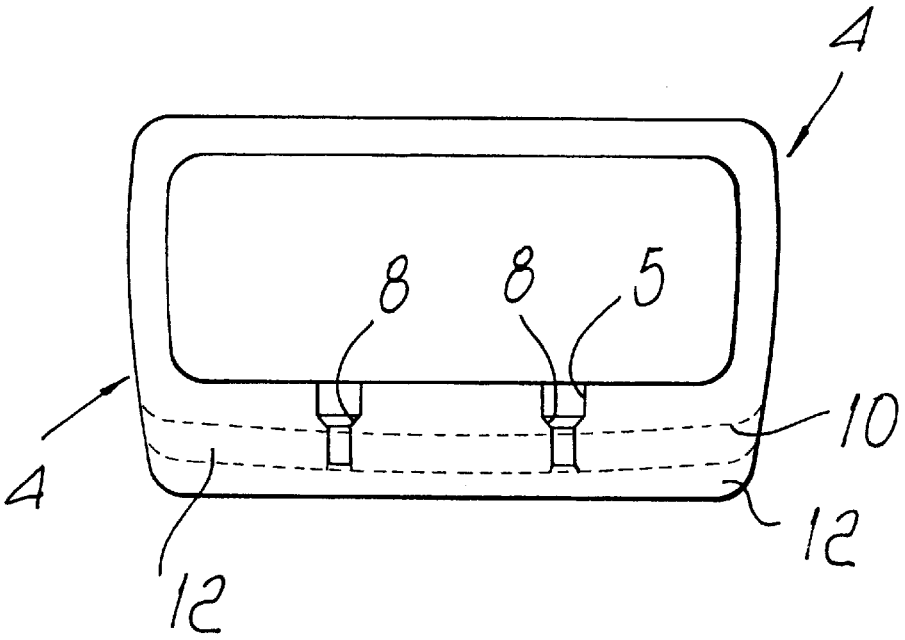
FIG. 5 shows still another embodiment of said outlet.
Figure 6:
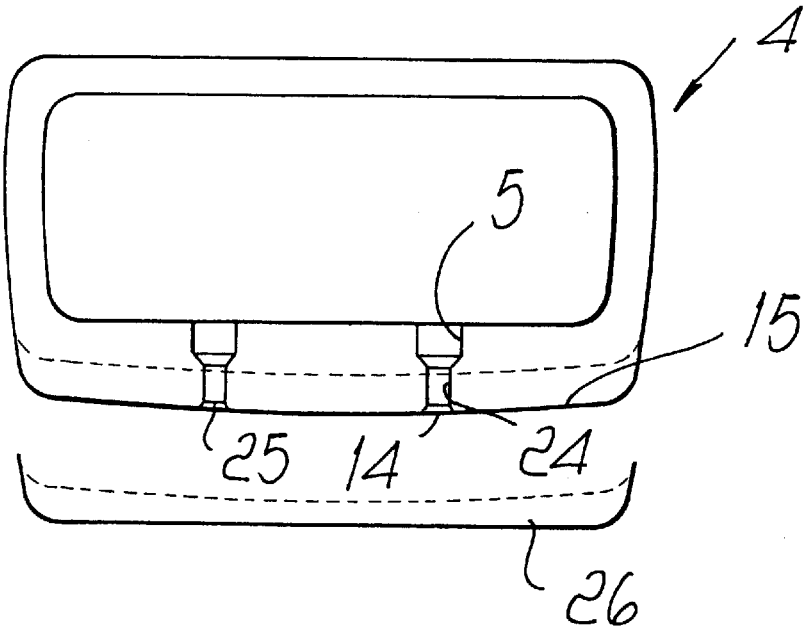
FIG. 6 illustrates the removal of the closing cap for allowing the liquid to be dispensed.

In a second embodiment, the outlet 14 is formed at the edge 15 of the tray 4, as shown in FIGS. 5 and 6. Exit ports 24 thermoformed in the tearing strips 12 communicate the outlet 14 with the cavity 5. Said cavity 5 has a circular cross section gradually tapering to the neck 8 whereat the exit port 24 begins which leads to the outlet 14. The outlet 14 defines flarings 25 and is closed by a tamper-proof cap 26 made by the outermost tearing strip 12. In this embodiment, the outlet 14 substantially faces the walls of the toilet bowl and the container 2 is arranged in such a way that the tray element lies in a horizontal or a slanted plane.

In operation, upon removal of the outer tearing strip 12 for opening the outlet 14, and after placing the dispenser 1 in the toilet bowl, the mass of liquid inside the container 2 pushes, under gravity, some of the liquid outwards, through the cavity 5. Such pushing action ends when the liquid bubble which forms at the outlet 14 and the flaring 25, builds up such a surface tension to balance the thrust of the fluid inside the container. Also in this case, by changing the section of the cavity 5 and neck 8 it is possible to vary the formation moment of the bubble at the outlet 14, whereas in order to change the quantity of liquid to be dispensed, the size of the outlet 14 has to be changed.

It is important to stress the fact that for a proper operation of the dispenser, a fluid should be selected having a viscosity such as to meet the requirements of both a warm and a cold environments, since the viscosity notoriously varies with temperature.

Moreover, it is fully equivalent to place the outlet 14 for dispensing the fluid on the second wall 7; in fact in this case it is sufficient to arrange the container such that the tray element is slanted.

Figure 7:
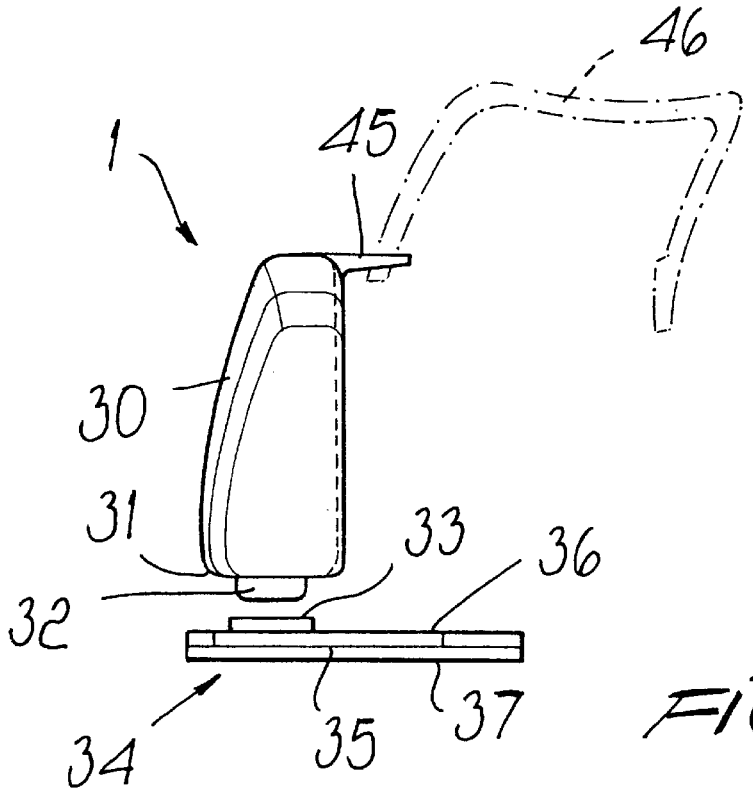
FIG. 7 is a side elevation cross-sectional view of a second embodiment of the dispenser.
Figure 8:
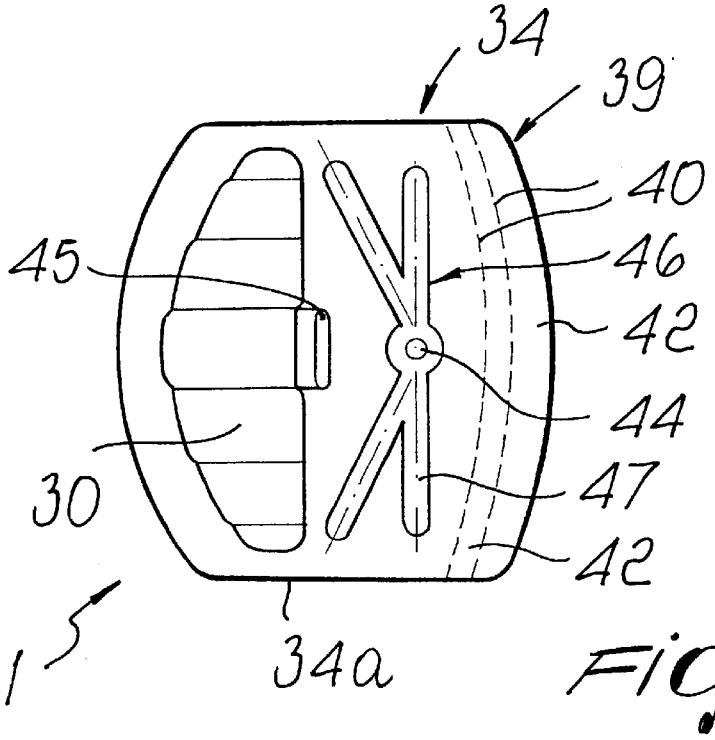
FIG. 8 is a top view of the dispenser in the embodiment shown in FIG. 7.

A second embodiment of the dispenser 1 is illustrated in the FIGS. 7 and 8. The dispenser 1 comprises a container 30, which is provided, at an end 31 thereof, with a coupling 32, sealingly and interlockingly engageable with an opening 33, formed on a tray element 34, separate from the container 30. The container 30 is manufactured by moulding, whereas the tray 34 could be manufactured by thermoformation or moulding. The tray 34 is internally provided with a cavity 35 which is communicated with the inside of the container 30 by inserting the coupling 32 in the opening 33. The cavity 35 is defined by a first wall 36 and a second wall 37 facing each other, and gradually tapering to a neck, as shown in the first embodiment. The tray 34 further comprises an outer lip 39, in which weakening lines 40 define one or more tearing strips 42. By removing one or more of the tearing strips 42, with the dispenser 1 placed in the toilet bowl, it is possible to adjust the distance of the tray 34 to the walls of toilet bowl itself.

Downwardly from the neck, the tray 34 has an outlet 44 closed by an adhesive cap, not shown in the drawings, to be removed before use. The outlet 44 allows the liquid to flow outwards from the inside of the container 2 and is designed, as specified hereinafter, so as to be located substantially below the rim of the toilet bowl, and thus be washed by part of the flushing water of the toilet bowl.

The first wall 36 peripherally defines an edge 34*a,* to which the second wall 37 made of a film of plastic material is thermosealed. Thermosealing of the second wall 37 to the edge 34*a* allows to close the tray 34 so as to make it suitable to dispense the liquid once it is coupled to is the container 30.

The outlet 44 is placed, as shown in FIG. 8, at an indentation 46 formed on the first wall 36. The indentation 46 forms diffusion grooves 47, preferably facing upwards, which extend in a radial pattern or web from the central area of the first wall 36. In this embodiment, the outlet 44 is at the center of the web, in order to allow a uniform diffusion of the liquid flowing from inside the container.

The dispenser 1 is provided with a hanger 45 associated with the container 30 for allowing the vertical positioning of said container in the toilet bowl, in such a way that the diffusion grooves 47 face upwards. To the hanger 45, a hook 46 is connected which interlockingly engages the rim of the toilet bowl. Finally, the positioning of the dispenser 1 inside the toilet bowl is eased by the tearing strips 42, which by being removed properly allow to adjust the distance between the tray 34 and the wall of the toilet bowl.

Finally, other embodiments could be devised for the tray 34 and the outlet 44, in addition to what is already disclosed above with reference to FIGS. 4 to 6.

It has thus been observed that the disclosed invention achieves the intended aim and objects.

In particular, it should be noted that in the invention thus conceived, it is the container itself that works as a dispenser for the sanitizing deodorant liquid.

In addition, the container by acting as a dispenser allows an optimum hygiene of the toilet bowl, in that it is periodically substituted with a new one, thus allowing to always have a hygienically-efficient dispenser.

The invention thus conceived is susceptible to numerous modifications and variations all of which fall within the scope of the appended claims.

All the details may further be substituted with other technically is equivalent.

In practice, the materials employed as well as the shapes and dimensions may be any according to requirements without thereby abandoning the scope of protection of the appended claims.

The disclosures in Italian Patent Application No. BO99A000677 from which this application claims priority are incorporated herein by reference.

What is claimed is:

1. A dispenser for sanitizing/deodorant surfactant liquids for toilet bowls, comprising: a container; a collector in continuous fluid communication with said container for a controlled dispensing fluid flow of a surfactant liquid to said collector for collecting the surfactant liquid from said container, said container and said collector being arranged in said dispenser such that the dispensing fluid flow of the surfactant liquid to said collector from said container stops when a surface tension in said collector balances a liquid pressure inside the container.

2. The dispenser of claim 1, wherein said collector is formed by an indentation provided in tray element connected to and protruding from said container.

3. The dispenser of claim 2, wherein said tray element comprises an outer lip, on which weakening lines are provided to form at least one tearing strip adapted to allow adjusting of a distance between the tray element and walls of said toilet bowl.

4. The dispenser of claim 2, wherein said tray element comprises first and second walls facing each other, a cavity of the tray element being formed between said first and a second walls, at least one outlet being provided at said cavity for fluid communication between said cavity and said indentation.

5. The dispenser of claim 4, wherein said cavity has a neck upstream of said outlet.

6. The dispenser of claim 4, wherein said controlled dispensing fluid flow comprises changing section of any of said cavity and of said outlet.

7. The dispenser of claim 4 wherein said first wall of said tray element is made monolithic with said container and said second wall of said tray element is made by a film of plastic material.

8. The dispenser of claim 1 wherein said collector is made monolithic with said container.

9. The dispenser of claim 8, wherein said container is manufactured by thermoformation and the second one of said walls is constituted by a film of thermoformable plastic material thermosealed along an edge of said first wall.

10. The dispenser of claim 1 wherein said collector and said container are monolithically made by thermoformation.

11. A sanitizing/deodorant surfactant liquid dispenser arranged in a toilet bowl, the dispenser comprising: a container; a collector in continuous fluid communication with said container for a controlled dispensing fluid flow of a surfactant liquid to said collector for collecting the surfactant liquid from said container, said container and said collector being arranged in said dispenser such that the dispensing fluid flow of the surfactant liquid to said collector from said container stops when a surface tension in said collector balances a liquid pressure inside the container, said dispenser being arranged in said toilet bowl such that said collector is arranged so as to be located below a rim of the toilet bowl, whereby to be washed by flushing water flowing in the toilet bowl.

12. The combination of claim 11, wherein said collector is formed by an indentation, an outlet being placed at said indentation.

13. The combination of claim 12, wherein said outlet is arranged on an edge of a tray element connected to and protruding from said container.

14. The combination of claim 13 wherein a first wall of said tray element is made monolithic with said container and a second wall of said tray element is made by a film of plastic material.

15. The combination of claim 14, wherein said container is manufactured by thermoformation and the second one of said walls is constituted by a film of thermoformable plastic material thermosealed along an edge of said first wall.

16. The combination of claim 12, wherein said indentation forms grooves for diffusion of said liquid, said grooves communicating with said cavity through said outlet.

17. The combination of claim 11 wherein said collector of said dispenser is made monolithic with said container.

18. The combination of claim 17 wherein said collector and said container are monolithically made by thermoformation.

* * * * *